US006451280B1

(12) United States Patent
Lebl

(10) Patent No.: US 6,451,280 B1
(45) Date of Patent: Sep. 17, 2002

(54) PROCESS FOR REGENERATION OF ACIDS FROM SPENT ACIDS

(75) Inventor: Albert Lebl, Graz (AT)

(73) Assignee: Andritz-Patentverwaltungs-Gesellschaft m.b.H, Graz (AT)

( * ) Notice: Subject to any disclaimer, the term of this patent is extended or adjusted under 35 U.S.C. 154(b) by 0 days.

(21) Appl. No.: 09/531,963

(22) Filed: Mar. 21, 2000

(30) Foreign Application Priority Data

May 22, 1999 (AT) ..... 506/99

(51) Int. Cl.[7] ..... C01B 7/07
(52) U.S. Cl. ..... 423/488; 423/592
(58) Field of Search ..... 423/488, 395, 423/592, DIG. 1, 483, 484, 633, DIG. 16, 394.2; 422/182; 95/234, 224; 96/275, 323, 355

(56) References Cited

U.S. PATENT DOCUMENTS 3,928,529 A * 12/1975 Grulke ..... 423/138
4,049,788 A 9/1977 Bierbach et al. ..... 423/592
4,144,092 A * 3/1979 Krepler ..... 134/12
4,197,139 A * 4/1980 Hjersted ..... 134/12
4,238,294 A * 12/1980 Takeuchi et al. ..... 203/72
4,255,407 A * 3/1981 Puurunen ..... 423/390
4,526,650 A * 7/1985 Blomquist et al. ..... 216/93
5,149,515 A 9/1992 Karner et al. ..... 423/393
5,244,551 A * 9/1993 Brucken et al. ..... 204/151
5,500,098 A * 3/1996 Brown et al. ..... 203/13
5,603,811 A * 2/1997 Lucas et al. ..... 203/12

* cited by examiner

*Primary Examiner*—Stanley S. Silverman
*Assistant Examiner*—Edward M. Johnson
(74) *Attorney, Agent, or Firm*—Roylance, Abrams, Berdo & Goodman, L.L.P.

(57) ABSTRACT

A process for regenerating spent acid liquor feeds an acid liquor into a reactor having a first heating zone for evaporating a substantial portion of the liquid from the spent acid to produce acid vapors and metal salts without decomposing the acid. The metal salts are transferred to a second heating zone where the salts are roasted to form metal oxides. The acid vapors from the primary roasting furnace are then transferred to an absorption column to regenerate the acid. The first heating zone is operated at a temperature below the decomposition temperature of the acid and the metal salts. The second heating zone operates at a higher temperature to completely oxidize the metal salts.

47 Claims, 1 Drawing Sheet

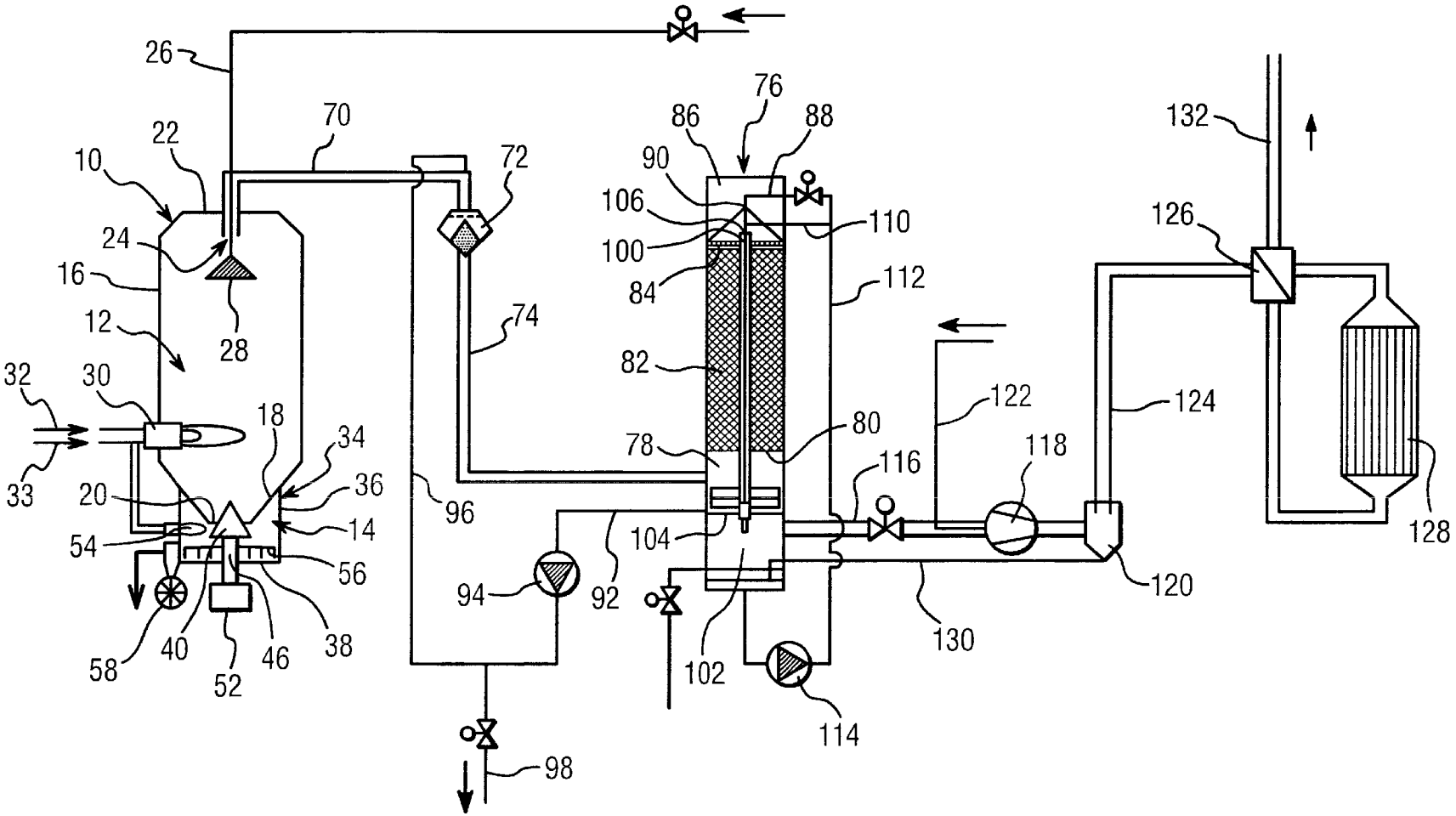
128
132
126
124
120
118
122
130
116
112
110
80
114
88
76
86
90
106
100
84
82
78
104
102
92
98
94
72
74
96
70
34
36
14
56
38
18
46
52
28
26
22
10
24
16
12
30
20
54
40
58
32
33

PROCESS FOR REGENERATION OF ACIDS FROM SPENT ACIDS

FIELD OF THE INVENTION

The present invention is directed to a process and apparatus for the regeneration of acids by pyrolysis of a spent acid liquor solution. More particularly, the invention is directed to a process and apparatus for the heating of spent acids in a primary heating zone of a furnace followed by heating in a secondary roasting zone.

BACKGROUND OF THE INVENTION

Pickling acids, such as hydrochloric acid and nitric acid, are used in the treatment of iron and other metals. Typically, the spent acids are regenerated for reuse in various processes to minimize waste and problems associated with disposal.

Several acid regeneration processes spray the spent acid through a furnace to pyrolyze or roast the various components and to produce acid vapors. The vapors are passed through an absorption column counter-currently to an absorption liquid which is typically water. The regenerated acid is then withdrawn through the bottom of the column. The pyrolysis exhaust gases are withdrawn from the head space of the absorption column by an external exhaust fan before discharging through a chimney.

Pickling acids of hydrochloric acid used to treat iron or steel produce numerous metal chlorides in the spent acid liquor. Many metal chlorides can be thermally converted into metal oxides and hydrogen chloride. The metal oxides are separated from the gaseous hydrogen chloride. The hydrogen chloride is then recovered as hydrochloric acid for regenerating the pickling acids.

The spent acid solutions are aqueous solutions that are sprayed as fine droplets into a heated reactor. The droplets are heated to evaporate the water from spent acid. After the water is evaporated, the metal compounds begin to decompose to the metal oxide. The droplets descend through the reactor in a free fall to a lower section in the reactor. The residence times are generally very short so that the droplets and metal compounds must be calcined by pyrolysis into the metal oxide and the acid vapor in a few seconds. The acid must be split from the metal oxide before the acid vapors can be removed from the head space in the reactor and the oxides removed from the bottom end.

The short retention time in the reactor always produces a certain amount of residual acid bonded to the metal salt. The residual acid is difficult to remove completely and remains in the oxide as an undesirable contaminant. To minimize residual acid in the metal oxide, the reactor temperature must be set sufficiently high to ensure that the larger droplets and the droplets in the center of the spraying cone are substantially calcined. There is a time delay in the conversion process starting at the outer edges of the spraying cone and moving inwards. As a result, the oxide is overheated and quality of the oxide deteriorates with the specific surface area becoming smaller. In addition, there is always a risk of higher or lower levels of acid vapors being discharged with the oxide.

One example of this type of process is disclosed in Austrian Patent No. 395,312. A disadvantage of this type of process is that evaporation and decomposition takes place in a single step at high temperatures causing considerable acid decomposition. When nitric acid is treated, high levels of nitric oxides (NO, $NO_2$) are produced. In addition, considerable cooling is needed to compensate for the high temperatures and, in some instances, the addition of oxidants is necessary. A similar process is also disclosed in U.S. Pat. No. 5,149,515. In this process, the acid being regenerated is evaporated in a counter-current flow using the exhaust from the reactor and then decomposed in the reactor. An other example of processes for regenerating acids is disclosed in U.S. Pat. No. 4,049,788.

Accordingly, a continuing need exists in the industry for an improved process for regenerating spent acid liquors.

SUMMARY OF THE INVENTION

The present invention is directed to a process and apparatus for regenerating spent acids, and particularly pickling acids. More particularly, the invention relates to a process and apparatus for the spray roasting of spent acid liquor where the reactor has a first heating zone serving as an evaporation zone and a second heating zone serving as a roasting zone.

Accordingly, a primary object of the invention is to provide a process and apparatus for the complete and uniform roasting of a spent acid liquor and recovering the acid vapors.

Another object of the invention is to provide a process and apparatus for heating a spent acid liquor in a first heating zone of a reactor to separate a substantial portion of the acid vapors and water from the metal salts and transferring the metal salts to a second heating zone or roasting chamber for converting the metal salts to metal oxides.

A further object of the invention is to provide a process for the spray roasting of spent pickling acids and regenerating acid without the formation of waste water.

Another object of the invention is to provide a process for regenerating acid by heating a spent acid in a first heating zone to vaporize the acid substantially without decomposing the acid.

A further object of the invention is to provide a process of regenerating acid by heating spent acid in a first heating zone of a reactor to separate acid vapors from metal salts substantially without decomposing the metal salts or forming metal oxides in the first heating zone.

Still another object of the invention is to provide a process and apparatus for heating a spent acid liquor at first temperature to evaporate the water from the liquor at a sufficiently low temperature to prevent decomposition of the acid and to prevent the formation of metal oxides followed by heating the metal salts to a second temperature to oxidize the metal salts.

The objects of the invention are basically attained by providing a process for regenerating spent acid liquor, comprising the steps of feeding a spent acid solution into a first heating zone of a reactor and heating the spent acid solution at a first temperature sufficient to evaporate a substantial portion of the water from the acid solution and to form particles of metal compounds and acid vapors, feeding the particles of metal compounds to a second heating zone of the reactor and heating at a second temperature to decompose the metal compounds, wherein the second temperature is higher than the first temperature, and recovering and regenerating an acid solution from the acid vapors.

The objects of the invention are further attained by providing a process of regenerating an acid solution from a spent acid solution containing a metal compound. The process comprises the steps of feeding the spent acid solution into an evaporating chamber of a reactor and heating the spent acid solution at a first temperature sufficient to evaporate a substantial portion of water from the spent acid solution and forming acid vapors and metal salts substantially without decomposing the acid and substantially without forming metal oxides, feeding the metal salt to a pyrolysis chamber of the reactor and heating the metal salts to decompose the metal salts and produce a metal oxide, and recovering the acid vapors from the reactor and regenerating the acid solution.

These and other advantages and salient features of the invention will become apparent from the annexed drawings and the detailed description of the invention.

BRIEF DESCRIPTION OF THE DRAWINGS

Referring to the drawings which form a part of the original disclosure in which:

The FIGURE is a schematic diagram of the acid regenerating plant in an embodiment of the invention.

DETAILED DESCRIPTION OF THE INVENTION

The present invention is directed to a process and apparatus for roasting spent acid liquor in the regeneration of an acid. More particularly, the invention is directed to a process for heating a spent acid liquor at a first temperature to separate acid vapors and metal salts and then heating the metal salts at a second temperature to roast and oxidize the metal salts to form metal oxides.

The process and apparatus is suitable for large scale acid regeneration plants. The present invention primarily relates to a process for separating and recovering acid vapors from spent acids that contain metal compounds. The acid vapors are recovered from the furnace and carried to further processing devices such as scrubbers and absorbers to regenerate the acids as shown in FIG. 1 and discussed hereinafter in greater detail. An example of suitable processing components for regenerating acid solutions from acid vapors is disclosed in commonly owned U.S. Pat. No. 5,149,515 to Karner which is hereby incorporated by reference in its entirety.

The process of the invention is particularly suitable for spent acids used in the treatment of various metals. Examples of acids that are particularly suitable for recovery include hydrochloric acid, nitric acid, hydrofluoric acid, sulfuric acid, and mixtures thereof. The spent acids can include pickling acids used in the treatment of iron, chromium, nickel, titanium, zirconium, aluminum, and the like. The spent pickling acids typically contain large amounts of metal salts that must be separated or decomposed during the roasting process to regenerate the spent acid efficiently. The process of the invention is particularly directed to regenerating hydrofluoric acid, nitric acid and mixtures thereof from spent acid solutions containing compounds of iron, chromium and nickel.

The process of the invention in a preferred embodiment feeds a spent acid solution into a reactor having at least two heating zones that can operate at two different temperatures. A first heating zone is preferably operated at a temperature that is sufficient to evaporate a substantial portion of water from the acid and produce acid vapors. Preferably, the temperature in the first heating zone is maintained at a sufficiently low temperature to prevent or inhibit decomposition of the acid and to prevent the formation of metal oxides in the first heating zone. However, the temperature in the first heating zone is sufficiently high to evaporate all or most of the water and produce the metal salts in particulate form.

The metal salts and other metal compounds in the spent acids are separated as solids in the first heating zone by the evaporation of water and vaporization of the acids. The metal compounds free fall downward through the first heating zone and are then immediately directed into a second heating zone. The second heating zone is operated at a second temperature that is higher than the first temperature and defines a decomposition zone. The metal salts are heated to a roasting temperature to decompose the metal compounds and form metal oxides. The metal oxides produced by the process of the invention are clean and substantially pure metal oxides being substantially free of acid residues and other impurities. The clean and substantially pure metal oxides produced by the process of the invention are suitable for sale and use in various processes. For example, the metal oxides are suitable for use as ferrites for the manufacture of magnetic strips.

Referring to the figure, the acid regenerating apparatus in a preferred embodiment of the invention includes a reactor 10 having a first heating zone 12 and a second heating zone 14. The reactor 10 includes a substantially circular side wall 16 and a frustoconical bottom wall 18 converging toward the center axis. A discharge opening 20 is provided in the bottom wall 18 and positioned substantially concentric to a vertical axis of the apparatus 10. An annular collar (not shown) extends downwardly from the bottom wall 18 and surrounds opening 20. The reactor 10 further includes a top wall 22 having an outlet opening 24. In the embodiment illustrated, a supply pipe 26 for supplying acid to reactor 10 extends through opening 24 into the top end of the first heating zone 12. A nozzle 28 is attached to the end of pipe 26 for spraying the spent acid solution into the first heating zone 12. A burner 30 is connected to a fuel supply pipe 32 and air supply pipe 33 for feeding hot combustion gases into the first heating zone 12.

A housing 34 is coupled to the lower end of the spray roasting apparatus 10. Housing 34 includes a substantially cylindrical side wall 36 and a bottom wall 38. Generally, bottom wall 38 is a flat wall substantially perpendicular to side wall 36. In the embodiment illustrated, side wall 36 is coupled to the conical bottom wall 18 of the apparatus 10. Housing 34 encloses and defines the second heating zone 14 and is positioned directly below the first heating zone 12. In one preferred embodiment, second heating zone 14 is coupled directly to first heating zone 12 so that metal compounds that are separated from the spent acid in first heating zone 12 are fed directly into the second heating zone 14. The second heating zone 14 is positioned directly below the first heating zone 12 so that the particulates are gravity fed to the second heating zone. In a preferred embodiment, the second heating zone 14 is integrally formed with the first heating zone 12. In alternative embodiments, the second heating zone is a separate unit coupled to the first heating zone 12.

As shown in the FIGURE, discharge opening 20 of the conical shaped bottom wall 18 has a substantially annular shape at the apex of the conical bottom wall 18. A cone 40 is positioned in the opening 20 to restrict the size of the opening and restrict the size of particles flowing from the first heating zone 12 into the second heating zone 14 as discussed hereinafter in greater detail. Cone 40 defines the size of the opening and restricts the flow of gases into the second heating zone 14. Cone 40 includes a solid tip and is coupled to a shaft 46.

Cone 40 is positioned in the discharge opening 20 and is dimensioned to provide a small gap between cone 40 and discharge opening 20. In embodiments of the invention, cone 40 can include a plurality of ridges or ribs to assist in breaking the particles into smaller pieces as they pass from the first heating zone 12 through the discharge opening 20 into the second heating zone 14. Shaft 46 is coupled to a motor 52 for rotating the cone 40 to feed the particulate materials from the first heating zone 12 into the second heating zone 14 at a substantially uniform and constant rate. The size of the gap between opening 20 in the bottom wall 18 and the cone 40 is selected to define the particle size of the metal compounds passing into the second heating zone 14. Generally, the particles entering the secondary heating zone 14 are about 1 to about 300 microns. In preferred embodiments, the gap is sufficiently small to effectively separate the first heating zone 12 from the second heating zone 14.

As shown in the FIGURE, a burner 54 is included in the second heating zone 14. Burner 54 is connected to the fuel supply 32 and air supply 33 to operate the second heating zone 14 at a temperature independent of the temperature of the first heating zone 12.

A mixing and conveying device 56 is provided in the bottom end of the secondary heating zone 14 adjacent bottom wall 38. In one embodiment of the invention, the mixing device 56 is a rake for mixing the solid materials in the second heating zone 14 and directing the materials to an outlet. A radial lock 58 is connected to the outlet of the second heating zone 14 to isolate the second heating zone 14.

In the process of the invention, waste acid, such as spent pickling acid, is fed through the pipe 26 and nozzle 28 and sprayed into the first heating zone 12. Hot combustion gases from burner 30 are fed through pipe 32 into the first heating zone 12 for heating and evaporating the spent acid. The droplets of the spent acid fall downwardly through the first heating zone 12 where a substantial portion of the water and acid components vaporize. The water vapor and acid vapors are withdrawn through opening 24 and directed to a suitable absorption column where an absorption liquid is contacted with the vapors to produce a regenerated acid. The metal salts in the spent acid fall through the hot combustion gases in the first heating zone 12. The selected temperature in the first heating zone 12 is dependent on the composition of the spent acid and the desired extent of oxidation of the metal salts. In one embodiment of the invention, the first heating zone is heated to a temperature of about 110° to about 350° C. In a preferred embodiment, the spent acid is heated to a temperature of about 150° C. to about 200° C. Decomposition of nitric acid is largely avoided at these temperatures.

In preferred embodiments of the invention, the first heating zone 12 is sufficient to vaporize the water in the spent acid and vaporize the acid so that the first heating zone forms an evaporating chamber for the spent acid. The temperature of the first heating zone is maintained sufficiently low to prevent decomposition of the acid and to prevent the substantial formation of metal oxides from the metal salts contained in the spent acids. In one embodiment of the invention, the spent acid comprises nitric acid and the temperature in the first heating zone is maintained at a temperature to vaporize the acid substantially without the formation of nitrogen oxides in the vapor stream. Heating the spent acids above the decomposition temperature results in low recovery of nitric acid, typically in the range of 30% to 50% of the acids originally present. Accordingly, the first heating zone is at a temperature to prevent decomposition of the acid and maximize recovery of the acid.

The particulates formed in the first heating zone 12, that are primarily composed of the metal salts and substantially free of acid, fall downward along the conical bottom wall 18 toward the outlet 20 and the cone 40. The motor 52 and shaft 46 rotate the cone about its axis to break up the oversized particulates into sufficiently small size particles, such that they can pass through the gap between the cylindrical side wall 50 of cone 40 and the edge of the opening 20 of the conical bottom wall 18. The metal salts fall downwardly through the gap into the second heating zone 14 and rest on the bottom wall 38 of housing 34.

A fuel and air mixture is fed to the burner 54 to heat the second heating zone to a desired temperature. Mixing device 56 being connected to the shaft 46 rotates simultaneously with the rotation of cone 40 to continuously mix the particles in the second heating zone 14. Continuous mixing of the particles by the mixing device 64 continuously exposes fresh surfaces of the particulates to ensure proper and uniform roasting and a uniform composition of the resulting metal oxides.

The temperature of the second heating zone is selected depending on the nature of the metal salts and the desired extent of roasting. In preferred embodiments, the temperature in the second heating zone is higher than the temperature in the first chamber. In one embodiment of the invention, the second heating zone is heated to a temperature of approximately 450°–900° C., and preferably 550° to 700° C. Preferably, the temperature in the second heating zone is sufficiently high to produce highly pure metal oxides. In addition, the second heating zone is at a roasting or oxidizing temperature sufficient to decompose the metal compounds and drive off any acid residues.

The secondary heating at the higher temperatures is particularly suitable for roasting metal chlorides to produce metal oxides that are substantially free of acid residues. Typically, the second heating zone is operated at a sufficiently high temperature to drive off the remaining acid residues from the particles and completely oxidize the metal salts without decomposing the oxides. The particles of the metal compounds that enter the second heating zone 14 are substantially free of acid so that little or no decomposition of the acid takes place in the second heating zone.

The exhaust gases from the reactor 10 are comprised of acid vapors, water vapor and dust. An outlet pipe 70 is coupled to reactor 10 and includes an open end defining outlet opening 24 of reactor 10. The exhaust gas is passed through a pipe 70 from reactor 10 to a jet or Venturi washer or scrubber 72 and through a pipe 74 to an absorption column 76. Venturi scrubber 72 can be a conventional venturi scrubber capable of treating the exhaust gases as known in the art. A scrubbing liquid is injected into the Venturi scrubber 72 to cool the exhaust gas, to remove dust particles and to remove some vapors. In one embodiment of the invention, the scrubbing fluid is a regenerated acid from an absorption column 76.

The gases exit the scrubber 72 and are fed through pipe 74 to a bottom end of absorption column 76. In the embodiment illustrated, absorption column 76 is a unitary structure having vertically positioned chambers. A bottom chamber 78 receives the exhaust gases from pipe 74 and regenerated acid and wash water from the column 76. A screen 80 extends across the column for supporting a bed 82 of absorption material such as gravel. A screen 84 is also provided at an upper end of the column to contain the absorption bed 82 and define a gas chamber 86 at the top end of the column 76. The exhaust gas is fed into the bottom chamber 78 and flows upward through the absorption bed 82 to the gas chamber 86. An absorption liquid, such as water or regenerated acid, is supplied through a pipe 88 to a spray nozzle 90 in the gas chamber 86. The absorption liquid is sprayed outwardly across the top of the absorption bed 82 and flows downward through the bed 82 to the bottom chamber 78. In one embodiment, the absorption liquid is rinse water from a pickling process.

The regenerated acid collected in the bottom chamber 78 is withdrawn through a pipe 92 by a pump 94. A portion of the regenerated acid stream is directed to the venturi scrubber 72 through a pipe 96. A second portion of the acid stream is withdrawn through a pipe 98 for subsequent use.

A wash column 100 is positioned in the absorption column 76 and extends from the gas chamber 86 downwardly through the bed 82 of absorbent material and through the collection chamber 78. A wash water collection chamber 102 is positioned directly below the chamber 78 such that a bottom wall 104 of chamber 78 defines the top wall of chamber 102. Collection chamber 102 serves as a reservoir for the absorption column 76 and the washing circuit.

The wash column 100 is a hollow tube having a first open end 106 positioned in the gas chamber 86 above the bed 82 of the absorbent material and an open bottom end 108 positioned in the wash water collection chamber 102. A washing liquid is sprayed through a pipe 110 by a nozzle positioned directly above the open end 106 of the wash column 100. The exhaust gas which passes upwardly through the bed 82 of absorbent material into the gas chamber 86 is directed downwardly through the wash column 100 where it mixes with the wash liquid being sprayed through the nozzle so that the droplets remove any further entrained particles or vapors.

The collected wash liquid is withdrawn from the collection chamber 102 through a pipe 112 by a pump 114 and carried to the nozzles in the gas chamber 86 as the absorption liquid.

In one embodiment of the invention, the absorption column is maintained at a temperature of about 70° C. to about 90° C. during the absorption of the acid vapors. In a preferred embodiment, the absorption column is maintained at a temperature of about 78° C. to about 85° C. In a further embodiment, the absorption process can be under adiabatic conditions to eliminate the need for heat exchangers and other temperature control devices.

The exhaust gas and any remaining vapor contained in the collection chamber are withdrawn through a pipe 116 by a fan or blower 118 to a separator 120 for removing any water droplets or particulate matter. A source of fresh water or wash water from a pickling line is introduced through a pipe 122 positioned upstream of the blower 118 to assist in removing particulates and vapors from the exhaust gas stream. The amount of fresh water added to the system is determined by the desired concentration of the regenerated acid. The exhaust gas is discharged from the separator 120 through a pipe 124 to a heat exchanger 126 and then to a catalytic treatment column 28. Liquids separated from the exhaust gas stream in the separator 120 are returned to the collection chamber 102 through a pipe 130. The gases from the catalytic treatment column 128 are directed through the heat exchanger 126 to a discharge stack 132.

The regenerating plant discussed above is an example of a suitable assembly. In further embodiments, a sodium hydroxide (NaOH) or calcium hydroxide ($Ca(OH)_2$) scrubber can be used. However, in this embodiment, the water from the scrubber cannot be used as the absorption liquid in the column. In a further embodiment, a heat recovery stage can be included between the reactor and the absorption column to boost the concentration of the waste pickling liquor. In still further embodiments, a cyclone separator can be provided downstream of the reactor to improve dust separation from the exhaust gas stream.

In the embodiment illustrated in FIG. 1, the waste wash water from the separator 120 is returned to the absorption column for mixing with the regenerated acid. Regenerated acid from the absorption column is recycled as the absorption liquid in the column and as the wash liquid in the venturi scrubber 72. In this manner, the system is a substantially closed system and does not discharge waste water that requires processing.

While several embodiments have been shown to illustrate the invention, it will be understood by those skilled in the art that various modifications and changes can be made therein without departing from the scope of the invention as defined in the following claims.

What is claimed is:

1. A process for recovering acids from a spent acid solution containing metal salts comprising the steps of feeding a spent acid solution into a first heating zone of a reactor and heating said spent acid solution at a first temperature sufficient to evaporate a substantial portion of the water from said acid solution to form substantially dry particles of metal compounds, water vapor and acid vapors, wherein said substantially dry particles are formed substantially without decomposing said metal compounds, feeding said particles of metal compounds from said first heating zone to a second heating zone of said reactor and heating at a second temperature sufficient to decompose said metal compounds, wherein said second temperature is higher than said first temperature, and recovering said acid vapors from said first heating zone and regenerating an acid solution from said acid vapors.

2. The process of claim 1, wherein said spent acid solution is selected from the group consisting of hydrofluoric acid, nitric acid, and mixtures thereof.

3. The process of claim 1, wherein said spent acid solution comprises a metal compound selected from the group consisting of iron, chromium, nickel, and mixtures thereof.

4. The process of claim 1, comprising heating said spent acid solution at said first temperature to vaporize said acid substantially without decomposing said acid and substantially without decomposing said metal compounds to metal oxides.

5. The process of claim 4, comprising heating said metal compounds in said second heating zone to a temperature sufficient to produce metal oxides.

6. The process of claim 1, wherein said first temperature is about 110° C. to about 350° C.

7. The process of claim 1, wherein said first temperature is about 150° C. to about 200° C.

8. The process of claim 1, wherein said second temperature is about 450° C. to about 900° C.

9. The process of claim 1, wherein said second temperature is about 550° C. to about 700° C.

10. The process of claim 1, further comprising feeding said acid vapors from said first heating zone of said reactor to an acid absorption column and absorbing said acid vapors to produce a regenerated acid.

11. The process of claim 10, comprising feeding said acid vapors through said absorption column at a temperature of about 70° C. to about 90° C.

12. The process of claim 10, comprising feeding said acid vapors from said reactor through said acid absorption column at a temperature of about 78° C. to about 85° C.

13. The process of claim 10, wherein said absorbing step is under adiabatic conditions.

14. The process of claim 10, further comprising feeding exhaust gases from said absorption column through a scrubber, feeding water into said scrubber, and scrubbing said exhaust gas.

15. The process of claim 14, comprising recovering waste water from said scrubber and feeding said waste water into said absorption column.

16. The process of claim 1, wherein said first heating zone is integral with said second heating zone and said process comprises feeding said metal compounds from said first heating zone directly into said second heating zone.

17. The process of claim 1, wherein said reactor is a spray reactor including said first heating zone and said second heating zone, and said process comprises spraying said spent acid solution into said first heating zone to form droplets of said spent acid solution in said first heating zone.

18. The process of claim 17, further comprising feeding hot combustion gases into said first heating zone to heat said spent acid solution at said first temperature to produce substantially dry particles of said metal compounds.

19. The process of claim 18, wherein said spray reactor includes a burner for feeding said hot combustion gases into said first heating zone.

20. The process of claim 17, wherein said second heating zone is positioned directly below said first heating zone, said process comprising spraying said spent acid solution into said first heating zone to produce said particles of metal compounds so that said particles of metal compounds fall downwardly from said first heating zone into said second heating zone.

21. The process of claim 1, wherein said process is a continuous process, further comprising spraying said spent acid solution in said first heating zone and heating to produce substantially dry particles of said metal salts and feeding said particles from said first heating zone directly to said second heating zone.

22. A process of regenerating an acid solution from a spent acid solution containing a metal compound, said process comprising the steps of feeding said spent acid solution into an evaporating chamber of a reactor and heating said spent acid solution at a first temperature sufficient to evaporate a substantial portion of water from said spent acid solution and forming acid vapors and substantially dry particles of metal salts substantially without decomposing said acid and substantially without forming metal oxides, feeding said metal salts from said evaporating chamber to a pyrolysis chamber of said reactor and heating said metal salts to decompose said metal salts and produce a metal oxide, and recovering said acid vapors from said reactor and regenerating said acid solution.

23. The process of claim 22, wherein said spent acid solution is selected from the group consisting of hydrofluoric acid, nitric acid, and mixtures thereof.

24. The process of claim 22, wherein said spent acid solution comprises a metal compound selected from the group consisting of iron, chromium, nickel, and mixtures thereof.

25. The process of claim 22, wherein said first temperature is about 110° C. to about 350° C.

26. The process of claim 22, wherein said first temperature is about 150° C. to about 200° C.

27. The process of claim 22, wherein said second temperature is about 450° C. to about 900° C.

28. The process of claim 22, wherein said second temperature is about 550° C. to about 700° C.

29. The process of claim 22, further comprising feeding said acid vapors from said reactor to an acid absorption column and absorbing said acid vapors.

30. The process of claim 29, comprising feeding said acid vapors through said absorption column at a temperature of about 70° C. to about 90° C.

31. The process of claim 29, comprising feeding said acid vapors from said reactor through said acid absorption column at a temperature of about 78° C. to about 85° C.

32. The process of claim 29, wherein said absorbing step is under adiabatic conditions.

33. The process of claim 29, further comprising feeding exhaust gases from said absorption column through a scrubber, feeding water into said scrubber, and scrubbing said exhaust gas.

34. The process of claim 33, comprising recovering waste water from said scrubber and feeding said waste water into said absorption column.

35. The process of claim 22, wherein said first heating zone is integral with said second heating zone and said process comprises feeding said metal compounds from said first heating zone directly into said second heating zone.

36. The process of claim 22, wherein said reactor is a spray reactor including said evaporating chamber and said pyrolysis chamber, and said process comprises spraying said spent acid solution into said evaporating chamber to form droplets of spent acid solution in said evaporating chamber.

37. The process of claim 36, wherein said spray reactor includes a burner for feeding said hot combustion gases into said evaporation chamber.

38. The process of claim 36, wherein said pyrolysis chamber is positioned directly below said evaporating chamber, said process comprising spraying said spent acid solution into said evaporating chamber to produce said metal salts, whereby said metal salts fall downwardly from said evaporating chamber to said pyrolysis chamber.

39. The process of claim 38, further comprising withdrawing said acid vapors from said evaporating chamber, directing said acid vapors to an absorption column and regenerating said acid solution.

40. The process of claim 22, wherein said process is a continuous process further comprising spraying said spent acid solution into said evaporating chamber and heating to produce substantially dry particles of said metal salts, and feeding said substantially dry particles directly form said evaporation chamber to said pyrolysis chamber.

41. A process for regenerating an acid from a spent acid solution containing metal salts comprising the steps of spraying a spent acid solution into a first heating zone of a spray roasting reactor to form droplets of said spent acid solution and heating said droplets of spent acid solution at a first temperature sufficient to form substantially dry particles of metal compounds and acid vapors substantially without decomposing said metal compounds, feeding said substantially dry particles of metal compounds from said first heating zone to a second heating zone of said reactor and heating said particles of metal compounds at a second temperature sufficient to decompose said metal compounds, wherein said second temperature is higher than said first temperature, and recovering said acid vapors from said first heating zone and regenerating an acid solution from said acid vapors.

42. The process of claim 41, further comprising heating said spent acid solution in said first heating zone to vaporize said acid substantially without decomposing said acid, and to prevent oxidizing said metal compounds to metal oxides in said first heating zone.

43. The process of claim 41, comprising the step of feeding hot combustion gases into said first heating zone to heat said spent acid solution.

44. The process of claim 41, comprising feeding hot combustion gases to said second heating zone to oxidize said metal compounds.

45. The process of claim 41, comprising spraying said spent acid solution into an upper end of said first heating zone whereby said droplets fall downwardly through said heating zone to a bottom end.

46. The process of claim 41, comprising heating said droplets in said first heating zone to a temperature of 110° C. to 350° C.

47. The process of claim 46, comprising heating said metal compounds in said second heating zone at a temperature of about 450° to 900° C.

* * * * *